US009494364B2

(12) United States Patent
Robertson et al.

(10) Patent No.: US 9,494,364 B2
(45) Date of Patent: Nov. 15, 2016

(54) DRYER HOPPER

(71) Applicant: Process Control Corporation, Doraville, GA (US)

(72) Inventors: Joseph D. Robertson, Doraville, GA (US); Dana G. Darley, Doraville, GA (US)

(73) Assignee: Process Control Corporation, Doraville, GA (US)

( * ) Notice: Subject to any disclaimer, the term of this patent is extended or adjusted under 35 U.S.C. 154(b) by 444 days.

(21) Appl. No.: 14/193,858

(22) Filed: Feb. 28, 2014

(65) Prior Publication Data

US 2015/0247670 A1 Sep. 3, 2015

(51) Int. Cl.

| | |
|---|---|
| ***F26B 17/12*** | (2006.01) |
| ***F26B 5/00*** | (2006.01) |
| ***F26B 3/06*** | (2006.01) |
| ***F26B 21/00*** | (2006.01) |

(52) U.S. Cl.
CPC ..... *F26B 17/12* (2013.01); *F26B 3/06* (2013.01); *F26B 21/004* (2013.01)

(58) Field of Classification Search
CPC ..... F26B 17/12; F26B 3/06; F26B 21/004
See application file for complete search history.

(56) References Cited

U.S. PATENT DOCUMENTS 5,702,246 A * 12/1997 Dam ..... C21B 13/0073 432/102
5,738,511 A * 4/1998 Borah ..... F27B 1/005 432/100
7,568,297 B2 * 8/2009 Pierson ..... F26B 9/103 219/697

* cited by examiner

*Primary Examiner* — Jiping Lu
(74) *Attorney, Agent, or Firm* — Thomas | Horstemeyer, LLP

(57) ABSTRACT

A dryer hopper assembly that promotes even drying of particulate matter across the horizontal cross-section of the hopper. In an aspect, the hopper promotes airflow up and alongside the interior wall of the hopper in counter-current flow to particulate material passing through the hopper. In one or more aspects, heating and thus drying of the material is promoted from the interior periphery of the horizontal cross-section of the hopper assembly towards the central axis of the hopper. The interior of the hopper may include a first perforated section located about a central axis of the hopper, the first perforated section having an outer peripheral edge spaced inwardly apart from the interior wall of the wall section, and a second perforated section, a first portion of the second perforated section being adjacent to the inner wall of the hopper and a second portion of the second perforated section providing an opening in communication with a central material outlet through which material may pass, the first perforated section having an open area and the second perforated section having an open area, the open area of the first perforated section being greater than the open area of the second perforated section.

20 Claims, 13 Drawing Sheets

DRYER HOPPER

TECHNICAL FIELD

This disclosure concerns a dryer hopper for drying particulate material. More particularly, this disclosure concerns a dryer hopper for drying polymer plastic material, such as polymer resin particulate material for use in a polymer extrusion process.

BACKGROUND

A number of commercial and industrial processes involve particulate or granular material. In some processes the moisture content of the particulate or granular material needs to be lowered before the material can be used in the process. An example is in the plastics field involving the use of plastic resins. The plastic resins may be initially granular materials produced in pellets. The plastic resin pellets may be processed by extrusion or other means in which the pellets are heated and molded or extruded into a desired shape. Many such plastic resin pellets have an affinity for water. Such hydroscopic particulate material cannot be properly processed by, for example, molding or extrusion. The heating in the molding or extrusion process can cause moisture in the pellets to vaporize creating imperfections in the final desired product. Other particulate or granular material may be produced having a moisture content that is too high for use in processes involving heating in which the vaporization of the moisture may interfere with the production of the final desired product. It is, therefore, desirable to dry such material before using it in such processes.

Conventional dryer hoppers for drying particulate material, particularly for drying polymer resin particulate material, suffer from a number of disadvantages. They typically consist of a vertically staged cylindrical housing. Particulate material to be dried is provided through the top of the housing and allowed to fall through the housing by gravity. Drying air is typically introduced into the hopper and may be passed into or up through the middle of the hopper. The upward flow of the drying air may be concentrated about the central portion or central vertical axis of the hopper on the belief that this is where the majority of the particulate material is concentrated. This can result in uneven drying of the particulate material. The material falling through the center of the housing may be dried to a greater extent than the material passing through the housing along or near the outer wall of the housing. Further, it tends to be inefficient, requiring greater airflow, and thus greater energy usage, than necessary to achieve sufficient drying of the material.

SUMMARY

The present disclosure addresses the problems associated with existing dryer hoppers. In particular, the present design provides a dryer hopper assembly that promotes more even drying of particulate matter passing through the hopper, especially across the horizontal cross-section of the hopper. Additionally it requires less airflow and lower energy demand to achieve the desired drying.

For example, in one or more embodiments, the present dryer hopper assembly provides more even airflow across the horizontal cross-section of the hopper, providing a flatter and more even temperature profile across the horizontal cross-section of the hopper for drying particulate matter passing through the hopper. As an example, in one or more aspects the present dryer hopper promotes airflow up and alongside the interior wall of the hopper in counter-current flow to the flow of the particulate material through the interior of the hopper in a direction opposite to that of the airflow. In one or more aspects of the present disclosure, heating, and thus drying of the material, is promoted from the periphery of the horizontal cross-section of the dryer hopper assembly towards the central axis of the hopper. In contrast, conventional dryer hoppers tend to heat, and thus dry, particulate matter passing through the hopper from the inside out, meaning from the central vertical axis of the hopper towards the inside wall at the outer periphery of the interior of the hopper. The result of the present outside in heating provides a flatter temperature profile across the horizontal cross-section of the hopper that results in more even, and more efficient, heating and drying of particulate matter passing through the hopper.

In an embodiment, the present disclosure provides a dryer for material, comprising:

a hopper having an interior formed by a wall section, a first end section and a second end section, the wall section enclosing the side or sides of the hopper, the wall section including an inner wall forming an outer periphery for the interior of the hopper, the first end section enclosing the hopper at one end of the wall section, and the second end section enclosing the hopper at an opposite end of the hopper;

the hopper further having an air inlet at or near the second end section and an air outlet at or near the first end section, an inlet at or near the first end section for introducing material to be dried into the interior of the hopper, and an outlet at or near the second end section for discharging material to be dried out of the hopper;

the interior of the hopper having a hollow first portion providing an unobstructed passageway for material introduced into the interior of the hopper from the material inlet; and the interior of the hopper having a second portion in communication with the hollow first portion, the second portion including a first perforated section located about a central axis of the hopper, the first perforated section having an outer peripheral edge spaced inwardly apart from the interior wall of the wall section, the second portion further including a second perforated section, a first portion of the second perforated section being adjacent to the inner wall of the wall section and a second portion of the second perforated section providing an opening in communication with the material outlet through which material may pass, the second perforated section having an interior wall having perforations there through, the perforations being in communication with the air inlet providing a passageway for air introduced into the interior of the hopper to flow through the air inlet and through the perforations in the interior wall of the second perforated section and directing air into the interior of the hopper, the outer peripheral edge of the first perforated section spaced apart from the inner wall of the second perforated section providing a passageway in between the interior wall of the second perforated section and the outer peripheral edge of the first perforated section, the passageway being in communication with the material outlet allowing material introduced into the interior of the hopper to pass between the interior wall of the second perforated section the and the outer peripheral edge of the first perforated section and out of the hopper through the material outlet.

Also provided is a method of drying material. In an aspect, the method comprises the steps of:

providing a hopper having an interior formed by a wall section, a first end section and a second end section, the wall section enclosing the side or sides of the hopper, the wall section including an inner wall forming an outer periphery for the interior of the hopper, the first end section enclosing the hopper at one end of the wall section, and the second end section enclosing the hopper at an opposite end of the hopper, the hopper further having an air inlet at or near the second end section and an air outlet at or near the first end section, an inlet at or near the first end section for introducing material into the interior of the hopper, and an outlet at or near the second end section for discharging material out of the hopper, the interior of the hopper having a hollow first portion providing an unobstructed passageway for material introduced into the interior of the hopper from the material inlet; and a second portion in communication with the first portion, configuring the second portion to include a first perforated section located about a central axis of the hopper and having an outer periphery spaced inwardly apart from the inner wall of the wall section and a second perforated section located between the outer periphery of the first perforated section and the inner wall of the wall section, the first perforated section having an open area and the second perforated section having an open area;

introducing material into the interior of the hopper through the material inlet and passing the material through the hopper; and delivering air into the interior of the hopper through the air inlet and passing the air through the interior of the hopper and out of the hopper through the air outlet.

In any one or more of the foregoing aspects air, which may be heated air, may be delivered into the interior of the hopper counter current to the flow of material through the hopper. The material may be introduced into the interior of the hopper and through the hollow first portion of the hopper in plug flow. In one or more aspects of the dryer, the first end section may be a top section and the second end section may be a bottom section of the hopper. Further the hollow first portion may be an upper portion and the second portion may be a lower portion of the hopper. The material to be dried may be particulate material, for example flowable particulate material.

In any one or more of the foregoing aspects, the first perforated section may have a perforated surface having an open area, the interior wall of the second perforated section having an open area and the open area of the perforated surface of the first perforated section is greater than the open area of the inner wall of the second perforated section. Air may be introduced into the interior of the hopper to flow through the air inlet and through the perforations in the interior wall of the second perforated section and directed to flow along the interior wall of the wall section towards the first end section of the hopper. When the air is heated air this may promote drying of material in the hopper outside-in from the interior wall of the wall section towards center, or central axis, of the hopper. For example, the open area of the interior wall of the second perforated section may be about 2.5% or less of the total interior surface of its interior wall, and the open area of the perforated surface of the first perforated section may be about 33% or higher. The open area of the interior wall of the second perforated section may provide a back pressure of about 1 psi or less in air passing through the second perforated section.

In any one or more of the foregoing aspects, the second perforated section may include a conical section, the conical section including an upper portion positioned adjacent to the inner wall of the wall section and including a lower portion truncated to provide an opening in communication with the material outlet through which material may pass, the conical section having an interior wall having perforations there through, the perforations being in communication with the air inlet providing a passageway for air introduced into the interior of the hopper to flow through the air inlet and through the perforations in the interior wall of the conical section and directing air into the interior of the hopper and to flow along the interior wall of the wall section towards the hollow first portion of the hopper, the lower portion further configured to include an inverted cone section positioned inside of the conical section and above the opening in the conical section, the inverted cone section having an outer lower peripheral edge spaced apart from the interior wall of the conical section, the spacing providing a passageway in between the interior wall of the conical section and the outer peripheral edge of the inverted cone section, the passageway being in communication with the material outlet allowing material introduced into the interior of the hopper to pass between the interior wall of the conical section the and the outer peripheral edge of the inverted cone section and out of the hopper through the material outlet.

In any one or more of the foregoing aspects, the dryer may include a blower and a conduit in communication with the blower and the air inlet for delivering air for drying material introduced into the hopper. The blower may have a variable speed motor and associated control to vary the speed of the motor for the blower. A measurement device to measure the flow of air delivered through the conduit by the blower, and a controller in communication with the measurement device for receiving air flow measurements from the measurement device and controlling the blower based on the air flow measurements may also be included. The controller may be configured to control the blower and/or blower motor to deliver between about 0.5 cfm to about 0.7 cfm of air per pound of material into the hopper, preferably about 0.6 cfm of air per pound of material into the hopper.

Other systems, methods, features, and advantages of the present disclosure for a dryer hopper will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Described below are various embodiments of the present systems and methods for a dryer hopper. Although particular embodiments are described, those embodiments are mere exemplary implementations of the system and method. One skilled in the art will recognize other embodiments are possible. All such embodiments are intended to fall within the scope of this disclosure. Moreover, all references cited herein are intended to be and are hereby incorporated by reference into this disclosure as if fully set forth herein. While the disclosure will now be described in reference to the above drawings, there is no intent to limit it to the embodiment or embodiments disclosed herein. On the contrary, the intent is to cover all alternatives, modifications and equivalents included within the spirit and scope of the disclosure.

Figure 1:
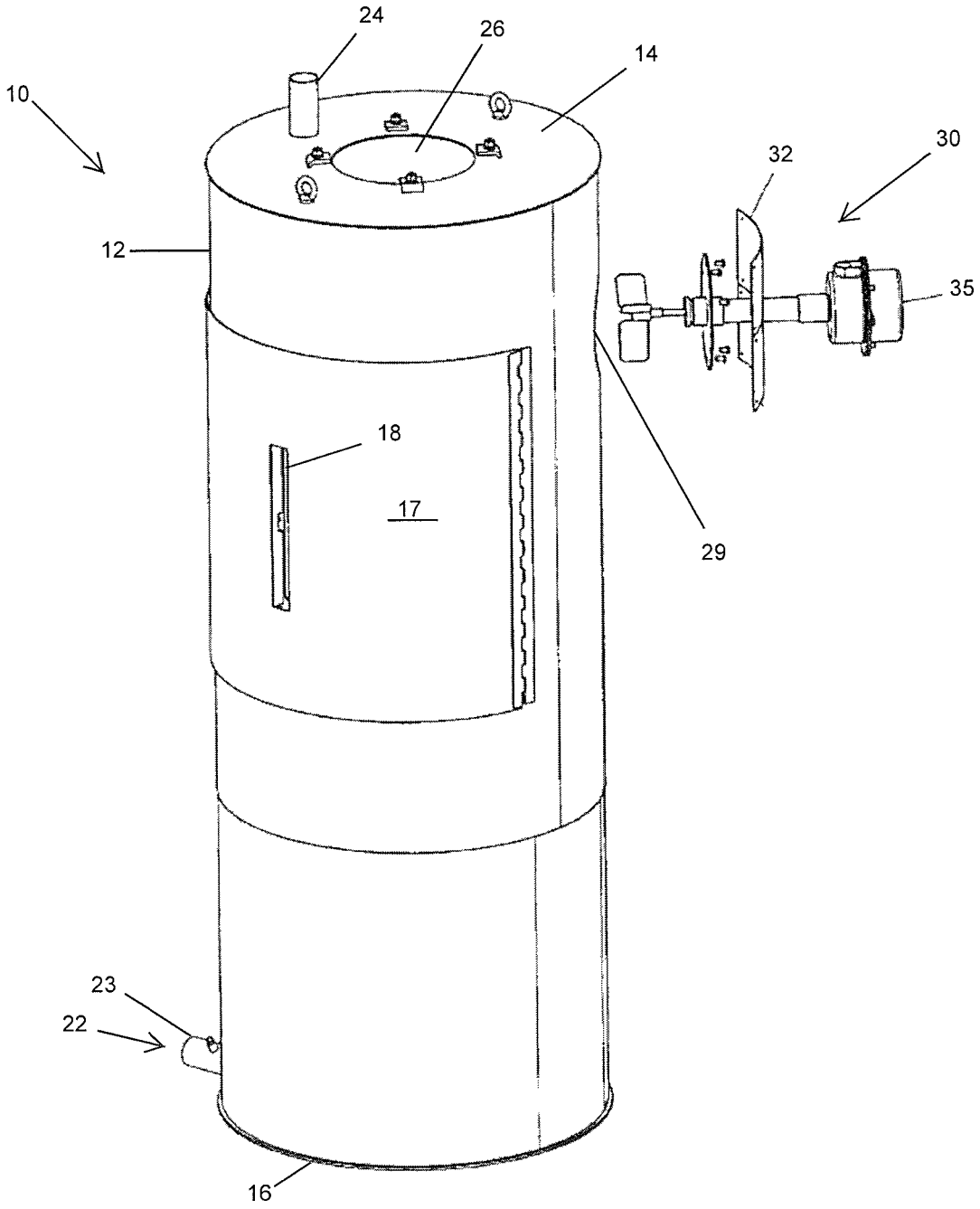
FIG. 1 is a perspective view of a non-limiting embodiment of the outside of the present dryer hopper.

Referring now in more detail to the drawings, in which like numerals indicate like parts throughout the several views, FIG. 1 illustrates a non-limiting example of a dryer hopper assembly 10 of the present disclosure. The dryer hopper 10 includes a wall section 12, a top section 14 and a bottom section 16. As depicted, the hopper is vertically oriented having a wall section 12 generally circular in horizontal cross-section. Other horizontal cross-sectional configurations of wall section 12 may be employed, such as but not limited to elliptical and quadrilateral cross-sections. Examples of quadrilateral cross-sections include square and rectangular cross-sections. As illustrated, the vertically oriented hopper has a central vertical axis.

The dryer hopper 10 may optionally include an access panel or door 17 and a sight glass or window 18 providing access and/or a view into the interior of the hopper. The dryer hopper further includes an air inlet 22 for providing drying air to the interior of the hopper and an air outlet 24 through which drying air may exit the hopper. The air inlet 22 may be provided at or near the bottom of the hopper, and the air outlet 24 may be provided at or near the top of the hopper. The air inlet 22 may be designed or adapted to be connected to a conduit 23, and the conduit 23 connected to a blower 21 for providing drying air to the interior of the hopper. The blower may include a variable speed motor (not shown) for varying the drying air delivered to the interior of the hopper. The drying air may be heated to promote drying of the material charged into the hopper.

A material inlet 26 is also provided for introducing material to be dried into the hopper, and a material outlet 28 is also provided. The material inlet 26 may be provided at or near the top of the hopper. The material inlet 26 may be designed or adapted to be connected to a reservoir (not shown), such as a hopper receiver, serving to receive and collect particulate material for discharge through the inlet 26 into the hopper 10. Such a reservoir may be used to control the flow of the material into the hopper and may be used to provide a consistent, steady state flow of material into and through the hopper. The material outlet 28 may be provided at or near the bottom of the hopper. Preferably the material outlet 28 is provided and configured in a manner to avoid or prevent accumulation of particulate material in the bottom of the hopper.

A port 29 may be provided in the side of wall section 12 of the hopper for receiving a level control 30. The level control 30 may be designed to monitor the flow of material to be dried through the hopper and to provide feedback for adjusting the flow rate of the material into the hopper as needed to avoid too much or too little material entering the hopper. The level control 30 may also be designed to provide a shut-off control to shut-off flow of material into the hopper. The level control 30 may include a cover plate 32 to cover port 29 and a controller 35 to provide the aforementioned control.

Figure 2:
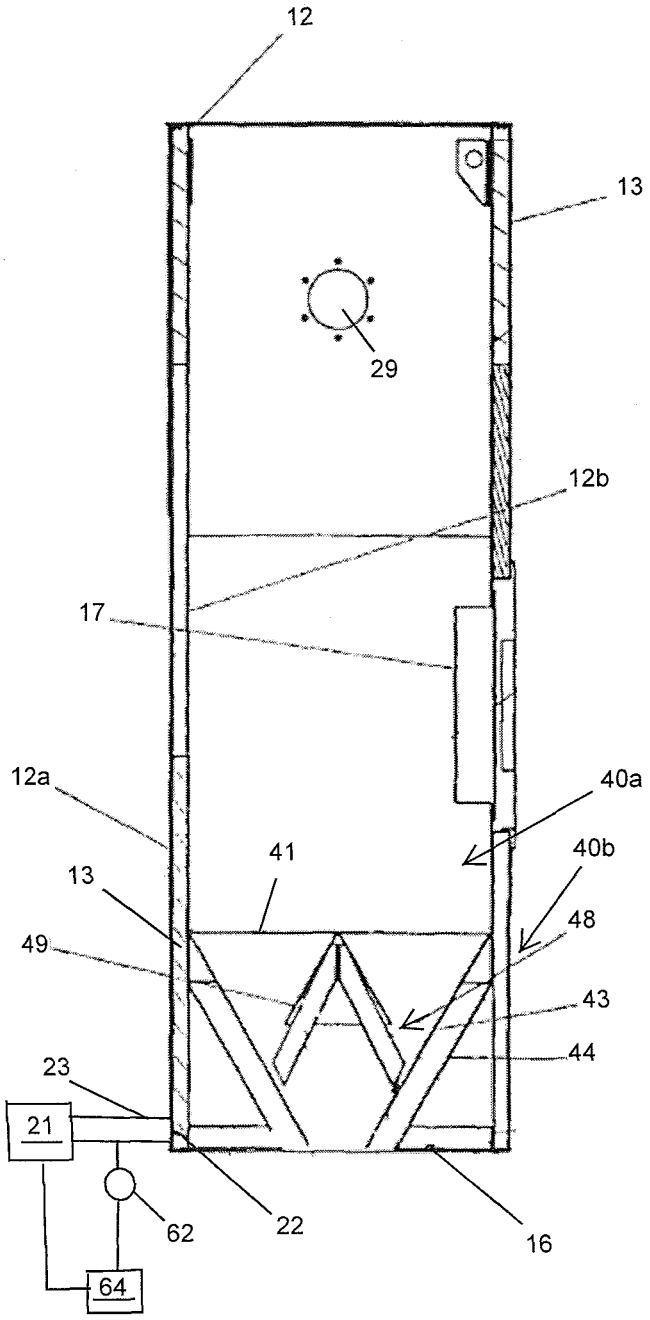
FIG. 2 is a vertical cross-sectional view of the dryer hopper FIG. 1.

A vertical cross-sectional view of the dryer hopper 10 of FIG. 1 is depicted in FIG. 2. In one or more aspects of the present disclosure, sidewall section 12 of the hopper may include an outer wall 12*a* and inner wall 12*b* and, optionally, insulation 13 between the inner and outer walls 12*a* and 12*b*.

Figure 3:
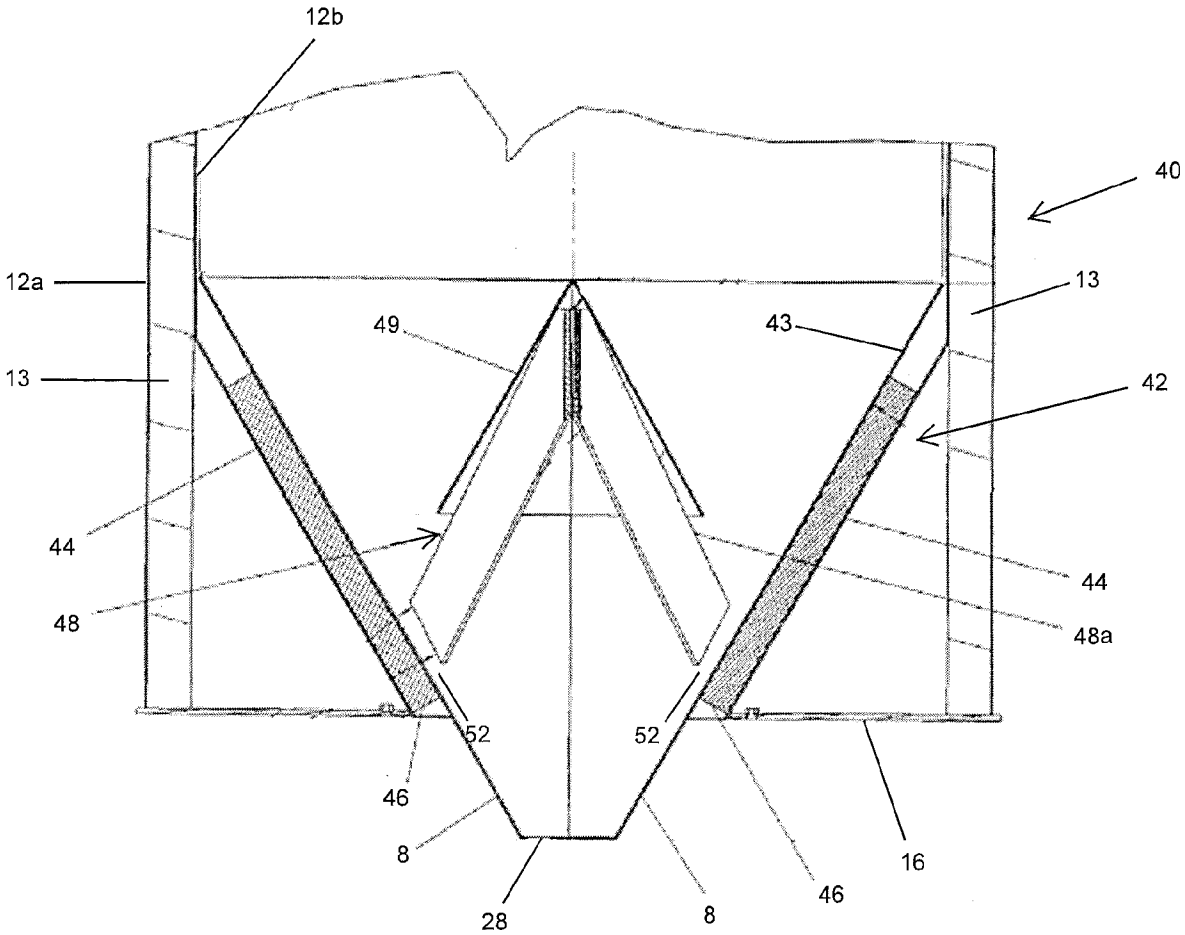
FIG. 3 is a detailed view of the lower portion of the cross-sectional view of the hopper of FIG. 2.

The dryer hopper 10 includes an upper portion 40*a* and a lower portion 40*b* (see FIG. 2 and in particular FIG. 3). The upper and lower portions 40 *a, b* are generally above and below line 41 shown in FIG. 2. As can be seen, the upper portion 40*a* of the hopper has a generally hollow interior, providing an unobstructed passageway for material passing through the hopper. The lower portion 40*b* includes a conical section 42 and an inverted cone section 48 positioned within conical section 42, both fixed within the lower portion 40.

Conical section 42 includes inclined inner and outer walls 43, 44, respectively. In one or more aspects the inner and outer walls 43 and 44 are positioned generally parallel to each other and inclined at an angle with respect to wall section 12. A spacing or channel 46 is provided between the inner and outer walls 43 and 44 serving as a conduit for receiving inlet air from air inlet conduit 23. In one or more aspects, inner and outer walls 43 and 44 may be inclined at an angle in the range of about 55° to About 65°. In an aspect they may be inclined at an angle of about 60°. Outer wall 44 is a solid wall while inner wall 43 is perforated to allow incoming air passing through passage 46 to pass through inner wall 43 and upwardly into the interior of the dryer hopper 10. Conical section 42, including perforated inner wall 43 may thus serve as an air diffuser.

In an embodiment, the perforations in inner wall 43 may be provided in a pattern in which all the perforations are equally sized, having equal diameters. The perforations are may be provided equally spaced along the full surface of inner wall 43 from its bottom to its top and around the wall. One skilled in the art will recognize, however, that other patterns of perforations may be provided. For example, the perforations be of unequal diameter. In other aspects the perforations may be provided in a pattern that provides more inlet airflow through the perforations adjacent and near the inner wall 12*b* of wall section 12, for example inner wall 12*b*, than away from the inner wall section towards the central axis of the hopper.

Inverted cone section 48 is provided in a fixed position within conical section 42 so as to provide a gap or spacing 52 between the outer lower edge of cone section 48 and the inner wall 43 of conical section 42. Spacing 52 provides a gap permitting particulate matter that is discharged into the top of the hopper to pass between the two conical sections and ultimately out of the hopper through the material outlet 28. In an aspect, material outlet 28 may be formed as a truncated conical section, the truncated portion forming the outlet for the material (see, e.g., FIG. 3).

Figure 4A:
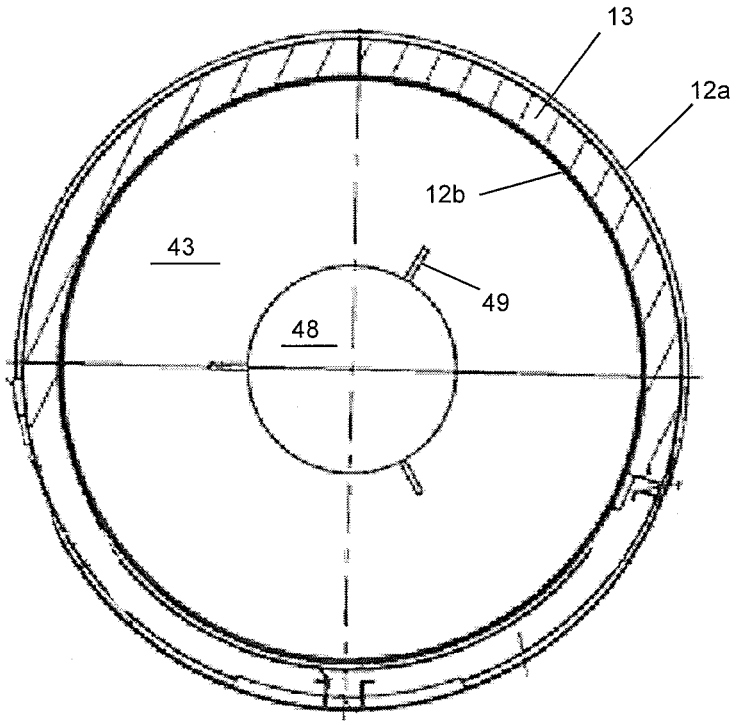
FIG. 4A is a horizontal cross-sectional view of the dryer hopper of FIG. 1.
Figure 4B:
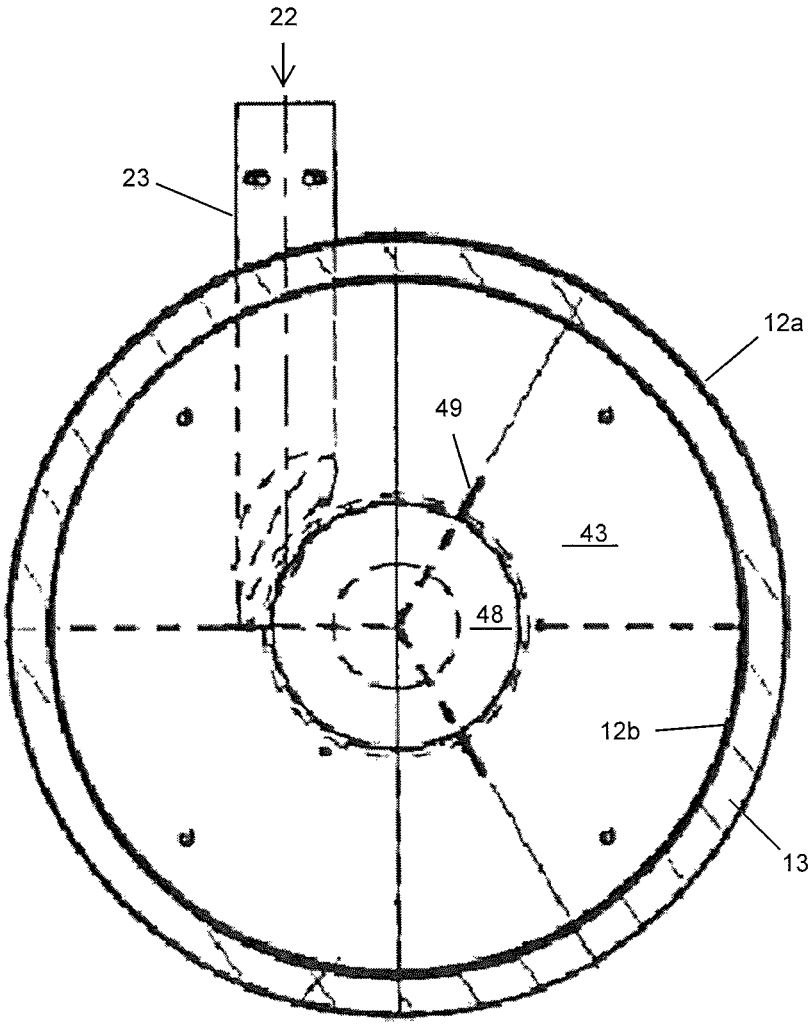
FIG. 4B is a further horizontal cross-sectional view of the dryer hopper of FIG. 1 detailing the air inlet to the bottom of the hopper.

The inverted cone section 48 may function as a material spreader serving to spread and distribute particulate matter within and ultimately out of dryer hopper 10. In one or more aspects, inverted cone section 48 may include one or more vanes 49 to assist in spreading the material. A horizontal cross-sectional view of dryer hopper 10 providing a top view looking down on the inner wall 43 of conical section 42 and the inverted cone section 48, including vanes 49, is depicted in FIG. 4A. FIG. 4B depicts a similar horizontal cross-sectional view of the lower portion 40 of dryer hopper 10 depicting a detail of exemplary drying air inlet 22 providing air to channel 46 between the inner and outer walls 43 and 44 respectively, of conical section 42.

In aspects of the present disclosure the material spreader 48 may be formed as a solid section, meaning for example that, unlike wall 43 of conical section 42, material spreader 48 is not perforated but instead is formed as a solid sheet. In this way drying air entering the hopper from air inlet conduit 23 and passageway 46 must enter the interior of the hopper through the perforations in wall 43 and around cone section 48.

In other, more preferred aspects, the material spreader 48 may be provided with a perforated surface in communication with conduit 23 such that air entering the hopper through air inlet 22 and conduit 23 is in communication with its perforated surface allowing air to pass through, in part, material spreader 48 upwardly into and through the interior of the hopper, as described in more detail below. In the more preferred aspects, the open area in the material spreader may be higher than the open area in the conical section, such as described below.

In one or more aspects, the dryer hopper 10 provides counter-current flow between the material to be dried entering the hopper through material inlet 26 and the drying air entering via air inlet 22. The material falls through the upper portion 40*a* of the hopper to the lower portion 40*b* unobstructed, such as by gravity, while at the same time drying air is introduced into the lower portion 40*b* of the hopper passing upwardly through the upper portion 40*a* and out air outlet 24. In various aspects the material to be dried passes through the inside of the hopper, in particular the upper portion 40*a* of the hopper, in plug flow. By plug flow we mean that material flowing downwardly through the interior of the hopper is flowing as a plug with no material moving faster than the material around it. Stated another way, plug flow may simply mean that the material first introduced into the interior of the hopper through material inlet 26 is the first material to exit the hopper through the bottom of the hopper.

In one or more aspects, conical section 42 serves as an air diffuser having a low percentage of open area. By open area we mean the percentage or ratio of open area presented by the perforations in wall 43 in relation to the overall surface area of wall 43 of air diffuser 42. As an example, in one or more aspects the percentage of open area, meaning the percentage of the surface area of wall 43 of diffuser 42 that is perforated, is about 2.5% or less of the total interior surface of wall 43. In other aspects the percentage of open area may be 2 percent or less. In even additional aspects the open area may be about 1.8% or less of the total surface area of wall 43. Even with such a low percentage of open area, the perforations in the interior surface of air diffuser 42 extend in its surface all the way to the outer periphery of the diffuser adjacent the internal portion 12*b* of sidewall 12. In one or more aspects the low percentage of open area in diffuser 42 generates a back pressure in the air passing through diffuser 42 into the interior of the hopper. In various aspects, the back pressure may be about 1 psi or less.

The material spreader 48 may be perforated in a manner creating a high open area, particularly in relation to the open area in diffuser 42. In various aspects, the surface of material spreader 48 may be perforated to have an open area of about 33% or more of the total surface area of its upper surface 48*a*. In some aspects the open area in the material spreader 48 may be 40% or higher. In other aspects the ratio of the diameter of the spreader cone 48 to the amount of open area in the surface of the material spreader may be 3:1.

Thus, in various aspects of the present disclosure, drying air is introduced into the hopper through air inlet 22 which inlet is positioned or located all the way at the bottom of the hopper. Further, as illustrated FIG. 4B, the air may be brought in tangentially at the bottom of the hopper, in particular, at the bottom of air diffuser 42. The low percentage of open area in air diffuser 42 reduces the amount of area that the drying air may pass through in diffuser 42 causing a back pressure on the air supply and forcing the air to distribute all the way around the back side of perforated wall 43 of diffuser 42 and across the full surface area of the diffuser.

Since diffuser 42 has open area that extends all the way to the top, outer periphery of the diffuser adjacent sidewall 12, drying air introduced into the hopper is not blocked in this section of the diffuser. In various aspects the velocity of the drying air through all the holes in wall 43 of diffuser 42 is equal and a consistent drying air velocity is provided into the interior of the hopper cross the full horizontal cross section the hopper.

The combination of the low open area in wall 43 of the diffuser 42 and the higher open area in material spreader 48 promotes flow of drying air up, along and adjacent inner wall 12*b*. This is believed to promote heating and drying of the particulate matter outside in from the outer periphery of the hopper at inner wall 12*b* towards its central vertical axis. Further in one or more aspects the combination of the low open area in wall 43 of the diffuser 42 and the higher open area in material spreader 48 promotes a constant temperature profile across the horizontal cross-section of the interior of the hopper, as shown in the Examples below.

Additionally air provided to air inlet 22 may be regulated to assist in providing the desired drying air distribution within the hopper, to maintain for example a constant velocity of the air and/or a constant temperature profile across the cross-section of the hopper. In an aspect, the flow of the air through the air inlet 22 or through conduit 23 may be measured by an air flow measurement device 62, for example a hot wire anemometer. A controller 64 may receive the air measurement and be used to control, for example, a variable drive motor (not shown) that serves to drive an air blower 21 for delivering the air to the hopper. In various aspects the inlet air may be regulated to 1.0 cfm/lb of material/hour or less, preferably to less than 0.7 cfm/lb/hr. In various aspects the inlet air may be regulated to be maintained within the range of less than 0.7 cfm/lb/hour to about 0.5 cfm/lb/hour, preferably to about 0.6 cfm/lb/hour.

EXAMPLES

We studied drying of hygroscopic materials at medium temperatures (190° F.), using various dryer hopper designs. Hot, dehumidified air heats the material, provides a low dew point atmosphere, vaporizes the internal moisture, and carries away the vapor. The moisture diffusion rate through such materials is too low for air velocity to affect the drying rate. Accordingly, the lowest air flow required to heat the material will handle the moisture with insignificant exit-air dew point differences.

Our study examined how time-temperature histories are related to air/material flow ratios. By momentarily stopping air flow, we made sure the temperatures recorded were for the material and not the air.

A frequently used term when indicating a unit's drying rate is the ratio of air flow, stated in cfm, for a material rate of 1 lb/hr. The data given below are for 0.6 cfm/lb and 1 cfm/lb, hereafter referred to as flow ratios of 0.6:1 and 1:1.

Figure 5:
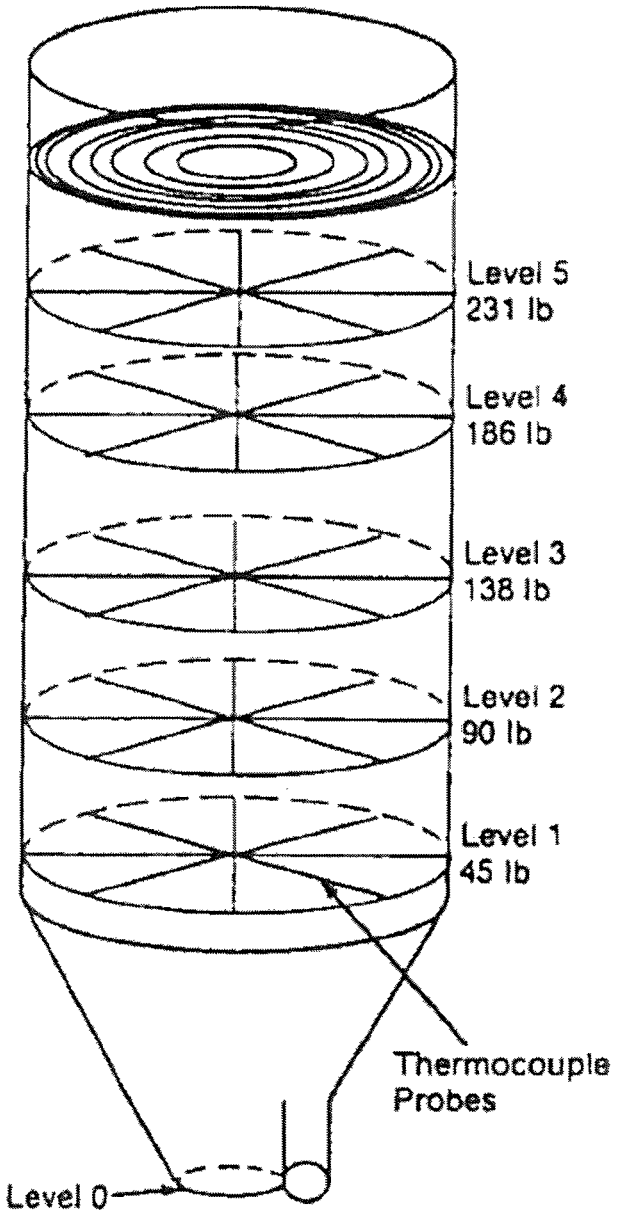
FIG. 5 is a schematic of a test hopper showing locations of thermocouple probes and material flow tracer pellet rings in the test hopper.

The test equipment consisted of several hoppers with different designs, each having a circular horizontal cross-section with a 20-in. inside diameter at its widest point and an operating capacity of 275 lb, plus 35 thermocouples, eight probes, 35 indicating/recording stations, air-flow meters, a hopper loader, an auger with d-c drive for conveying material from the hopper outlet, a dew point recorder, and a dehumidifying power unit. A general schematic of a test hopper showing various locations of thermocouple probes and material flow tracer pellet rings is depicted in FIG. 5. The material used was acrylonitrile butadiene styrene (ABS) pellets, 3/32 inch square, conditioned to various levels of moisture content prior to each steady-state test. By a steady state test we mean that the temperature inside the hopper has stabilized to a nearly constant if not a constant temperature.

The driving force for drying hygroscopic materials was created by elevated temperature of the material and low dew point in the surrounding air. Temperature plays an important role throughout the drying cycle, whereas dew point is not a significant factor until low moisture levels are reached. The effect of both temperature and dew point differentials on drying rate become progressively more pronounced as moisture levels decrease.

With these general concepts in mind, we performed tests to learn what real temperature profiles can be obtained in a well-engineered hopper, and at what cost for air flow. The respective hoppers were then operated with a material inlet temperature of 80° F. and an air inlet temperature of 190° F. at flow ratios of 0.6:1 and 1:1.

The first hopper tested was a dryer hopper having a tangential inlet located high on the cone for introducing air underneath a conical perforated distributor located in the center of the hopper on its central vertical axis. It also had an inverted perforated cone for material flow control. Temperatures were measured at four points across the uninsulated hopper plus the centerline, in 45° angular increments, at levels 1 through 4 (a total of 68 points), by shifting the probes. (See FIG. 5).

Figure 6:
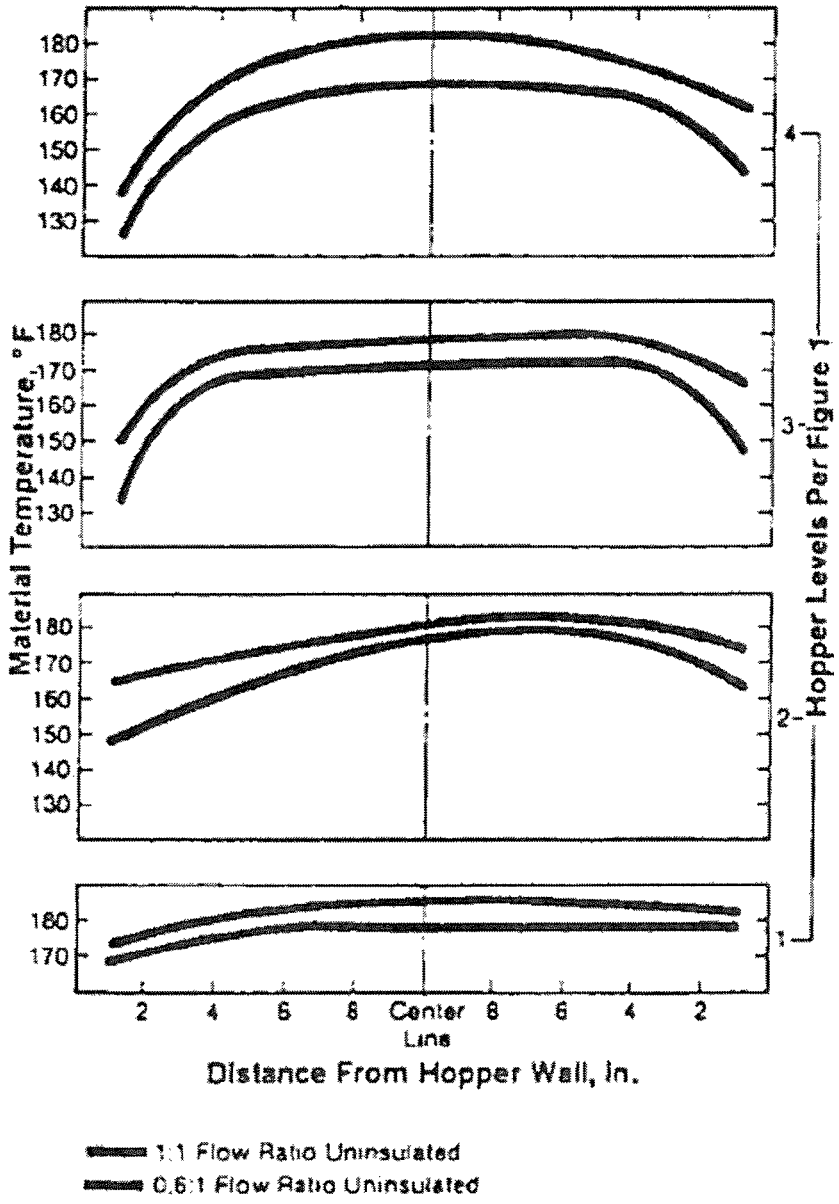
FIG. 6 depicts temperature profiles plotted at 4 levels, namely levels 1-4 of FIG. 5, for two different flow ratios at steady state in a conventional, uninsulated hopper.

The temperature profiles resulting from these tests are plotted in FIG. 6. FIG. 6 depicts temperature profiles plotted at levels 1-4 depicted in FIG. 5 for the two different flow rates of material at steady state in above uninsulated hopper (meaning in particular that the side wall section of the hopper was uninsulated). Note the asymmetrical temperature profiles that occurred during heat-up and persisted after 6 hr of steady-state operation. There are cool columns of material that severely affect hopper drying performance, even with a flow ratio of 1:1 and air temperature close to the material agglomeration temperature of approx. 200° F. Air flow through the distributor was obviously non-uniform. Surprisingly, we learned that pressure drop caused by air flow through material in the hopper will not compensate for this, even at flow ratios up to 1:1. Heat losses are so great with an uninsulated hopper that a ratio of 1:1 does not maintain temperature up through the hopper, even at the center point. We terminated testing on this hopper because of its obvious deficiencies.

Several hoppers were designed, built and tested until a unit was developed that gave symmetrical temperature readings and balanced material flow. Many test runs were made using this engineered balanced flow hopper of the present disclosure, during which temperatures were recorded at levels 1 through 5, as indicated in FIG. 5, after heat-up and 6 hr of steady-state operation. Temperature recording points of the material were at the wall and distances inward of 0.5, 1, 3.8, 4.5, 5.5 and 10 in., a total of 214 points.

Figure 7:
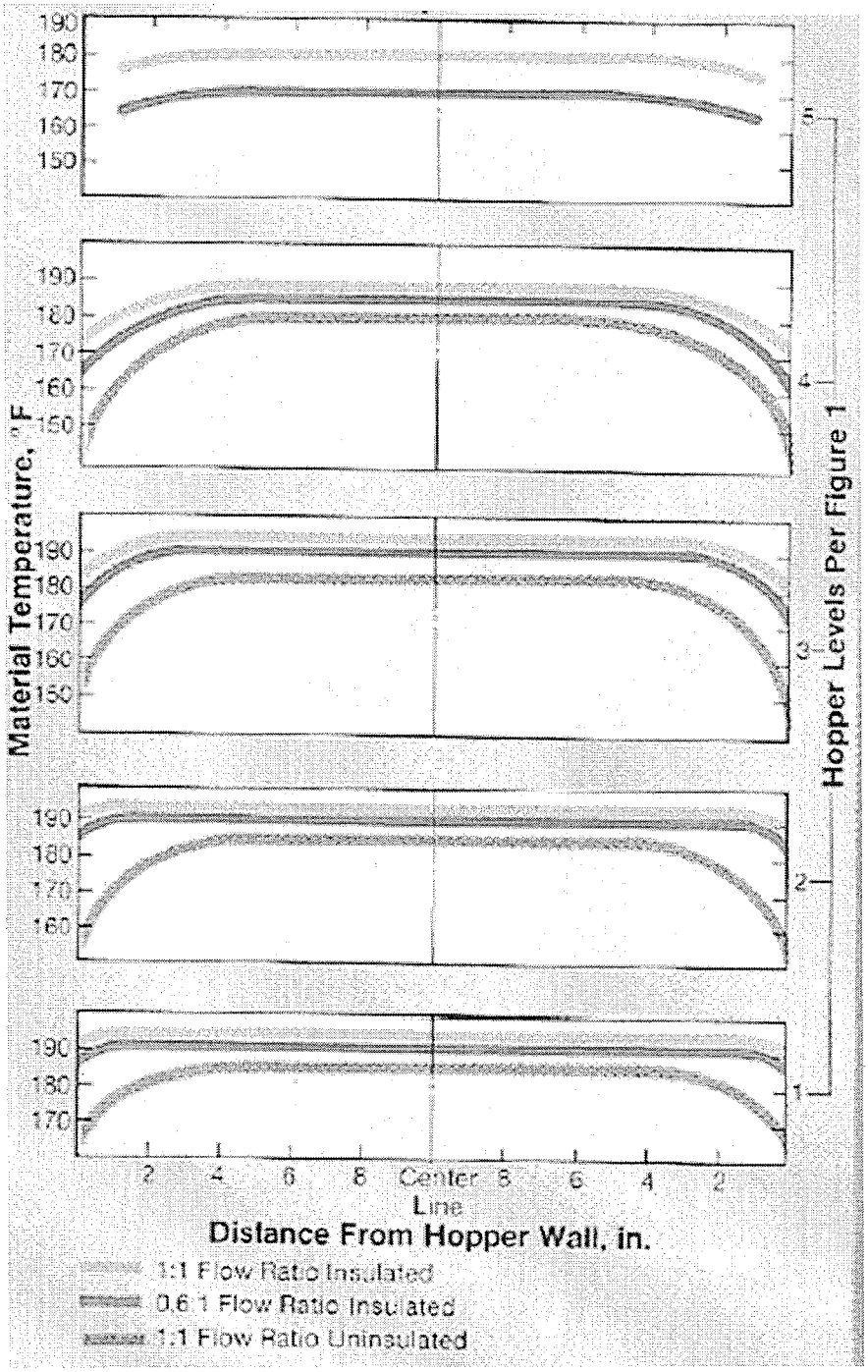
FIG. 7 depicts temperature profiles plotted at 5 levels of a test hopper, namely levels 1-5 of FIG. 5, for the two different flow ratios at steady state of FIG. 6 but in an exemplary dryer hopper of the present disclosure, both insulated and uninsulated.

Temperature profiles from this second series of tests are plotted at levels 1-5 at steady state, for both insulated and uninsulated wall section 12, in FIG. 7. Level 0 consistently indicated 190° F. and therefore is not shown. The symmetrical temperature profiles, which give uniform drying rates, are almost identical at levels 1 and 2 for flow ratios of 0.6:1 and 1:1, and are very close together at levels 3 and 4. As can be seen from a comparison of FIG. 7 to FIG. 6, the hopper of the present disclosure provided a more consistent, even (flat) temperature profile across the horizontal cross-section of the hopper at the various levels depicted in FIG. 5 even when comparing the uninsulated wall section of the first hopper to an uninsulated wall section of the present hopper design. Temperatures at the wall are satisfactory in an insulated hopper at both ratios, but undesirably low in an uninsulated hopper. Vertical temperature readings 4 in. inward from the wall (D/5) in an insulated hopper, as shown in FIG. 8, provide some indication of temperature profiles in the hopper for the two different flow ratios.

Seven concentric rings of different colored pellets were placed in the engineered hopper, as shown in FIG. 5. During steady-state operation at a flow ratio of 0.6:1 and material rate of 60/lb/hr, the exit time of each colored pellet was recorded. The exit time of the first pellet from each ring is plotted in FIG. 9 as a percentage of average residence time. It was found that the inverse of the residence-time profile matches up well with temperature profiles, resulting in thorough drying of all pellets. The pellet nearest the wall, for example, is exposed to the lowest temperature but has the longest residence time.

Figure 8:
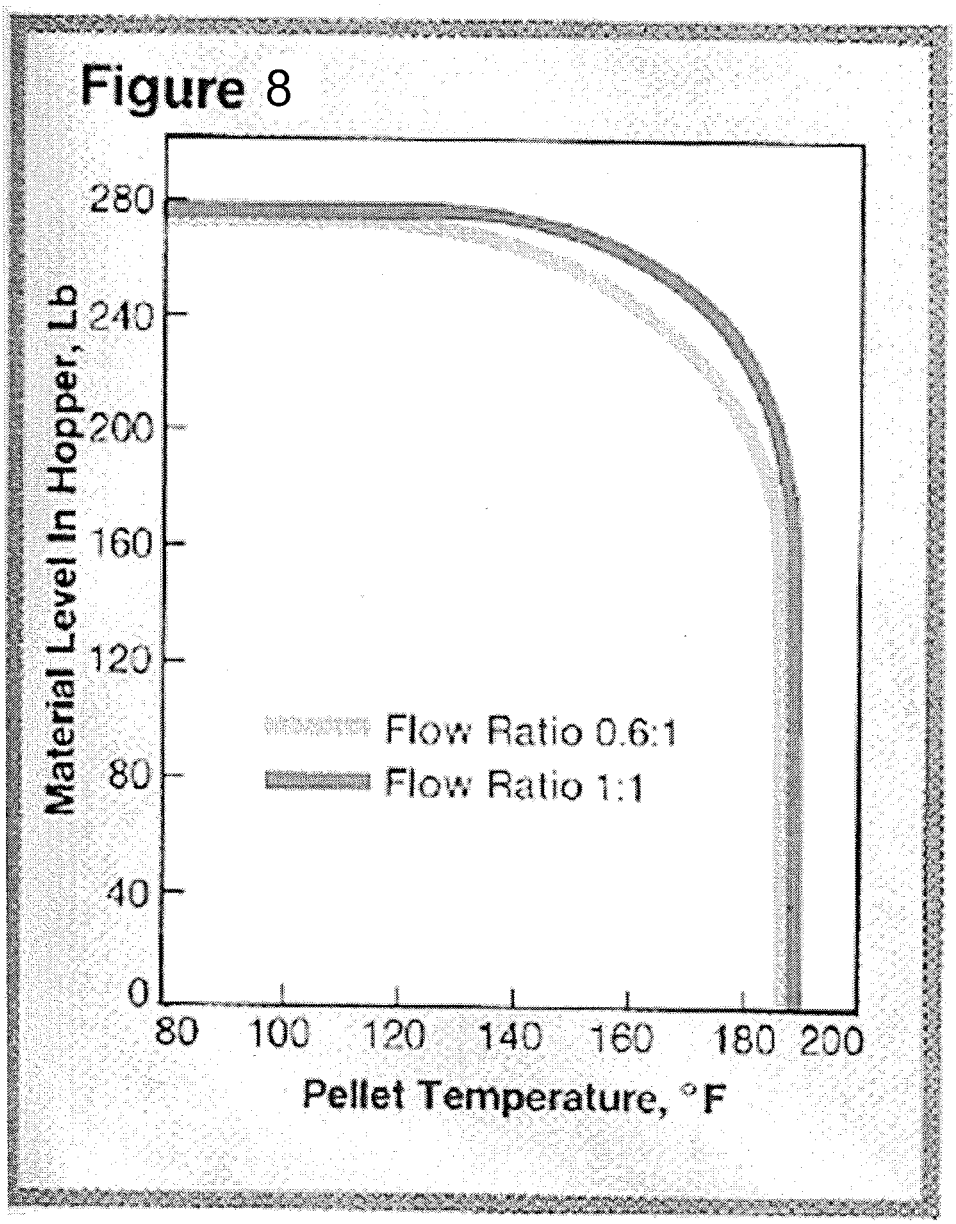
FIG. 8 plots vertical temperature profiles four inches from the inside wall in an exemplary insulated dryer hopper of the present disclosure for two different flow rates.
Figure 9:
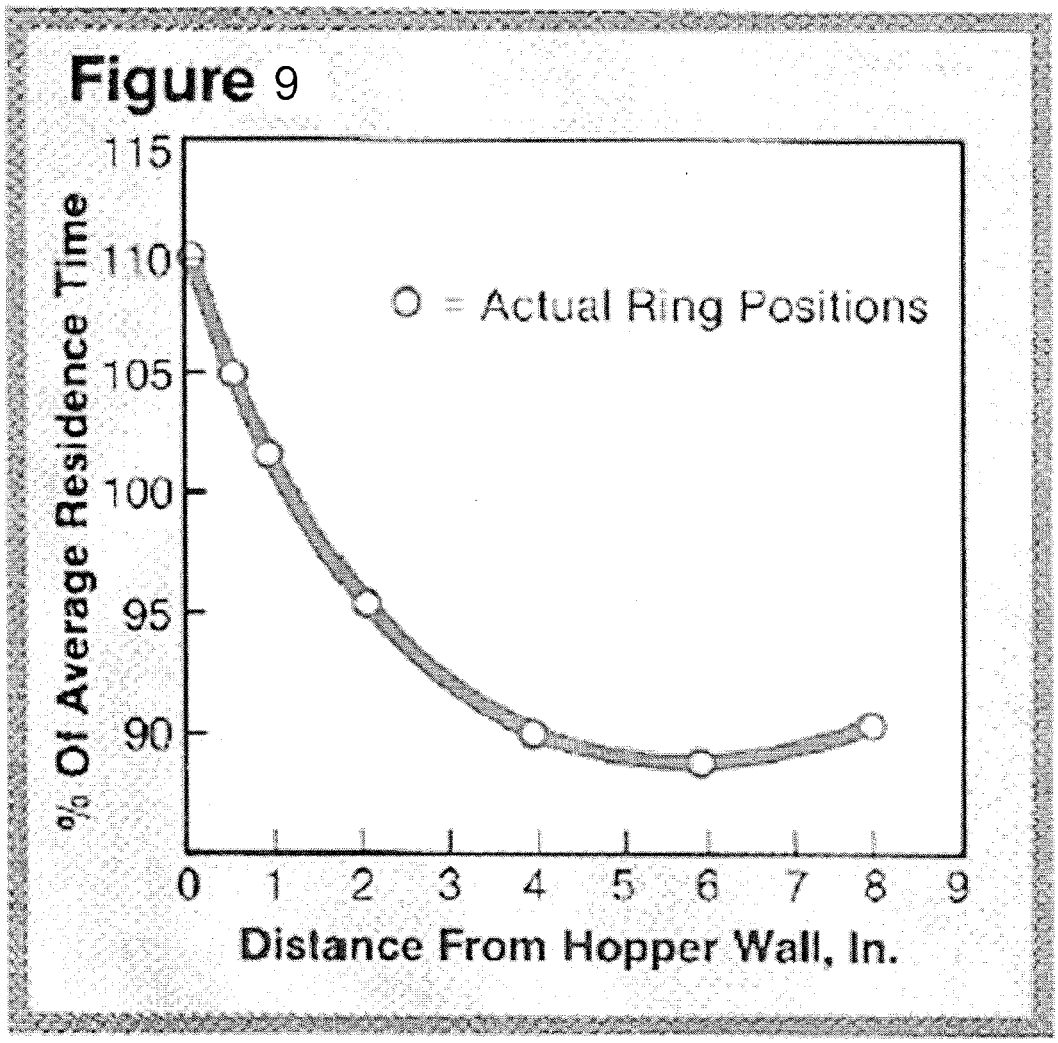
FIG. 9 plots the exit time of the first pellet out from each tracer ring depicted in FIG. 5 as a percentage of average residence time.
Figure 10:
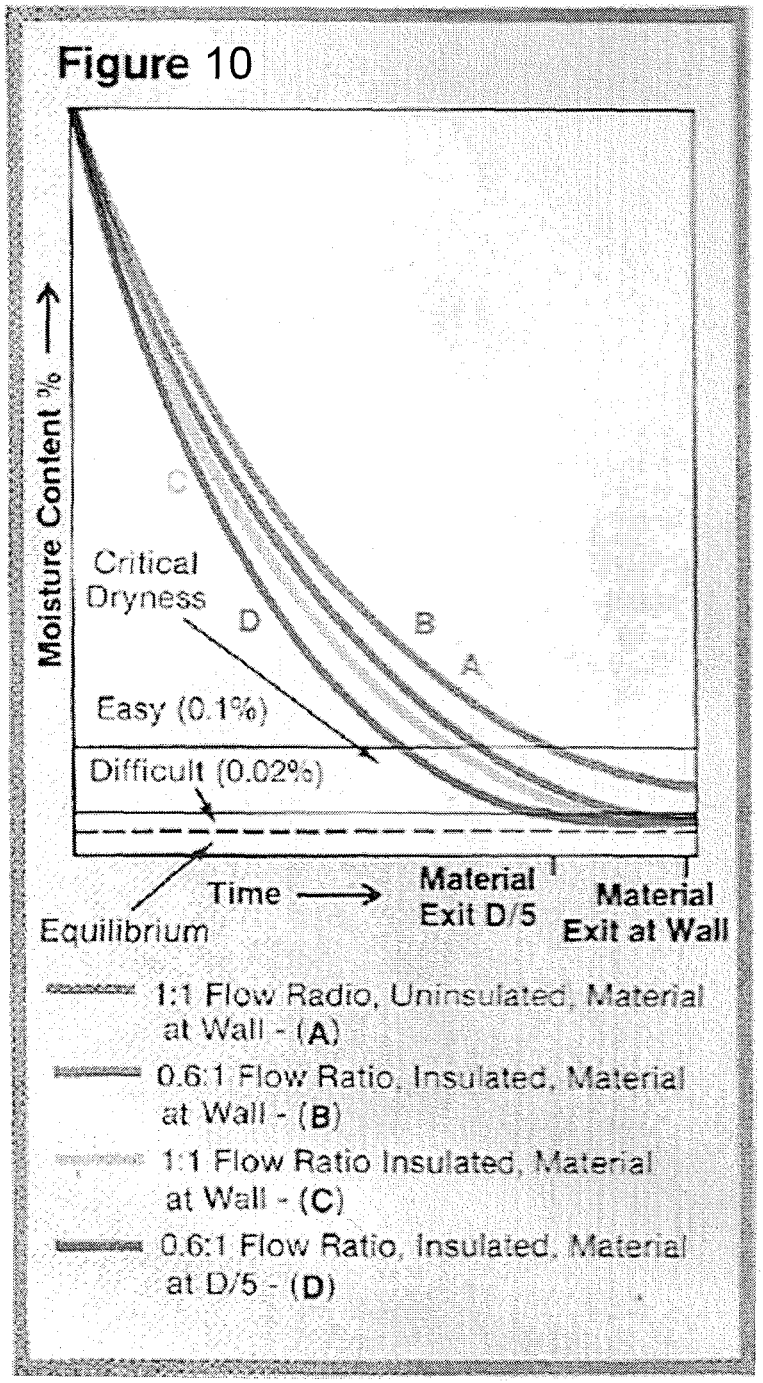
FIG. 10 depicts typical drying curves for two flow ratios in an exemplary dryer hopper of the present disclosure, both insulated and uninsulated.

FIG. 10 illustrates curves for typical drying situations for hygroscopic materials in the engineered hopper, under the conditions shown in FIGS. 7, 8 and 9, for the two flow ratios in the engineered hopper, both insulated and uninsulated. The shape of drying curves at constant temperature and humidity conditions is influenced by the type of material, pellet size and shape, and initial moisture; however, certain basic principles apply to all applications.

All drying curves are falling-rate types in which the slope starts out steep and becomes progressively flatter towards equilibrium. Initially, temperature rather than dew point is the primary driving force, but the effect of temperature differentials on drying rate starts out low and becomes increasingly important as dryness approaches equilibrium. Also, dew point exerts more and more influence on drying rate as the moisture level falls. Excess air flow raises the temperature of air returned to the dehumidifying unit, which will adversely affect dew point and, consequently, final drying rate and ultimate dryness.

Material that flows down the middle 60% of the hopper diameter (represented in FIG. 10 by curve D) dries at about the same rate for either flow ratio and faster than material at the wall, but exits sooner. The drying rate for material at the wall (curves B & C) starts out faster at a 1:1 flow ratio but is approximately equal for both ratios in the final 1½ hours of drying. In other words, the material dried at 1:1 approaches the dryness limit sooner, but the material at 0.6:1 continues drying and reaches the same dryness soon after. Material in an uninsulated hopper (curve A) will dry much slower and will have much less chance of reaching the safe dryness zone.

Thus, for the same final moisture content, drying with a 0.6:1 flow ratio may, depending on how close safe drying is to equilibrium, incur a one-time cost for a slightly larger hopper; whereas higher air-flow ratios will cost more for energy during the entire life of the system.

Figure 11:
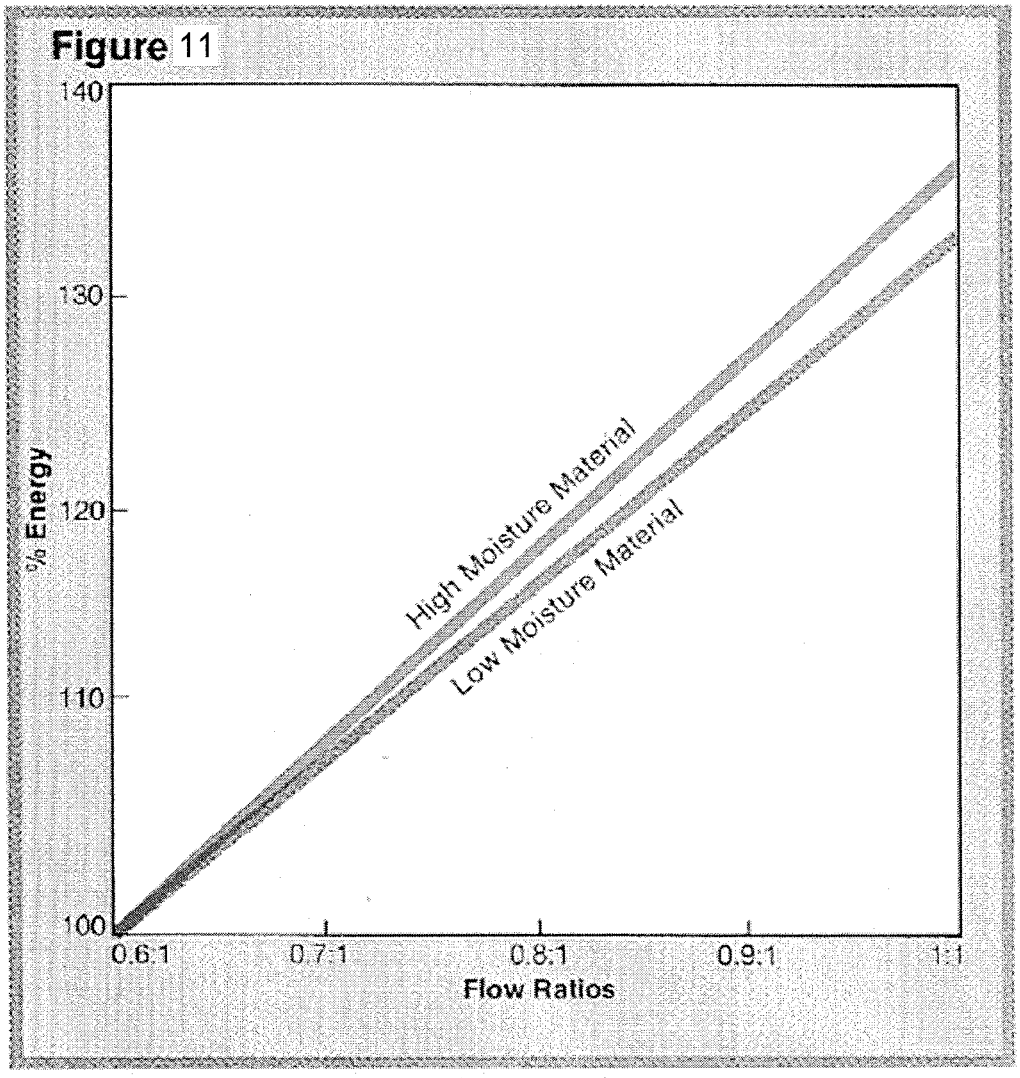
FIG. 11 plots energy consumption in a drying circuit for an exemplary dryer hopper of the present disclosure for two different flow rates.

FIG. 11 plots energy consumption in the drying air circuit for the two flow ratios. Any flow ratio above 0.6:1 wastes energy, up to about 35% at 1:1, as shown in FIG. 11, even when using the same insulated hopper and dehumidifying units with similar features. This comparison is only for heating material, moisture vaporization, and unavoidable convection and radiation losses, and does not consider losses caused by bad practices such as heating the air at the dehumidifying unit rather than at the hopper.

With the engineered hopper, the material in and out temperatures are the same for flow ratios of 0.6:1 or higher, so an equal amount of heat is put into the material. However, since a flow ratio of 1:1 contains 1.67 times the heat of 0.6:1, exhaust air from the hopper is proportionately hotter and therefore a considerable quantity of heat is lost from the duct that returns air to the dehumidifying unit. Additional energy is wasted by desiccant bed inefficiencies and added horsepower requirements caused by excess air flow. The drying circuit energy ranges up to 45% of the total, so excess air flow can cost a hefty additional 16% of total drying energy.

Connected load is not a good indicator of energy usage, so data for energy comparisons should be gathered using a watt-hour meter on systems operating at comparable steady-state rates.

Figure 12:
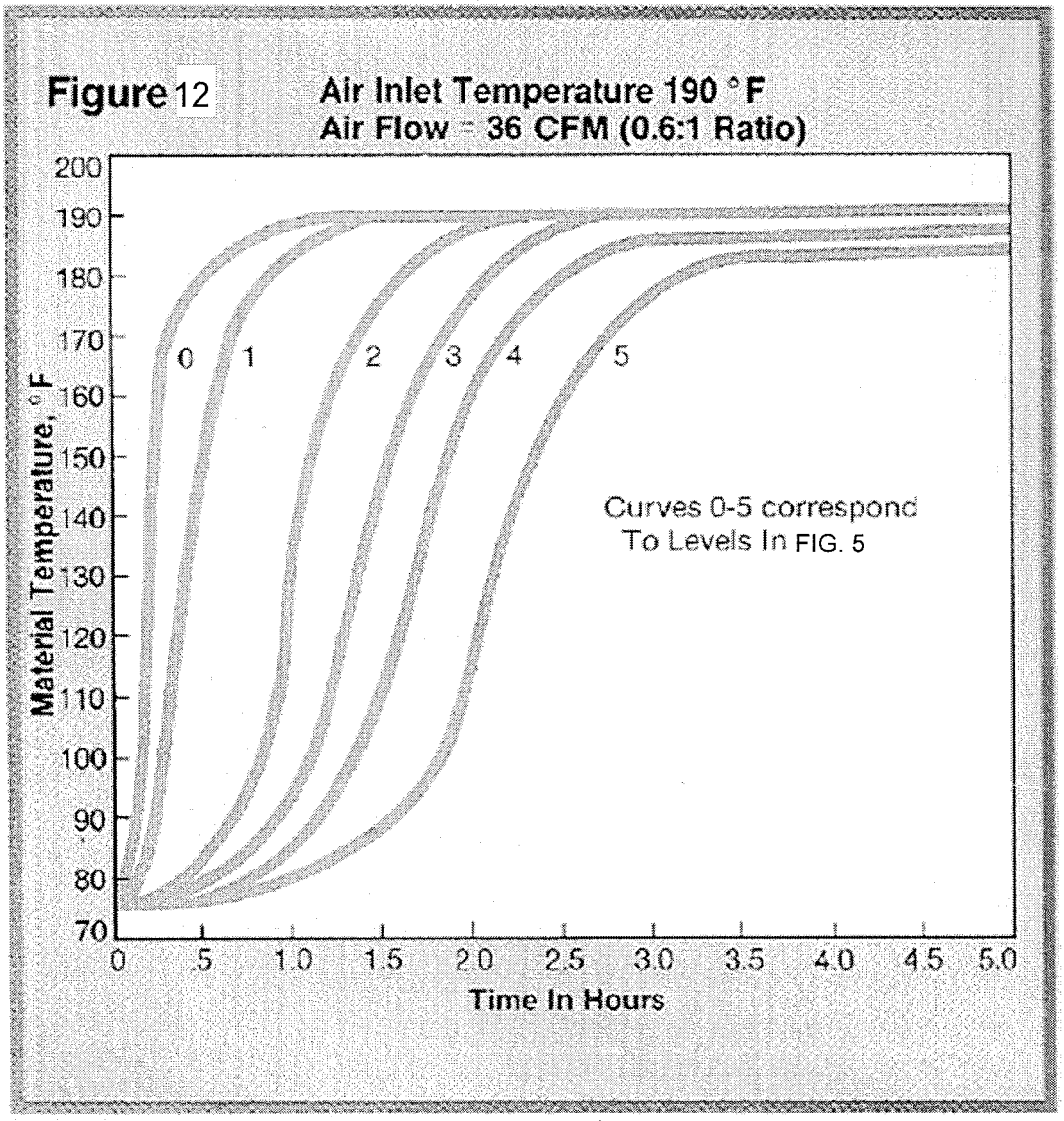
FIG. 12 shows the results of pellet heat-up temperatures versus time for six different levels in an exemplary dryer hopper of the present disclosure.

FIG. 12 shows the results of pellet heat-up temperatures over time with an air flow of 36 cfm (0.6:1 ratio) and an air inlet temperature of 190° F. for six different hopper levels. Twenty-five points were recorded at levels 0 through 5, as indicated in FIG. 5. Material at the very bottom (level 0) was hot enough to start drying in 15-20 min, to which must be added required drying time. The other curves show that by the time material at level 0 is dry, other levels up through the hopper are partially dry and hot enough to provide enough residence time, so that processing can begin. This holds true for the entire hopper area, with every position across the diameter reaching a temperature at least as high as that for steady-state drying.

For example, if 3 hours of drying time at temperature is required, minimum start-up time is 3 hours, 15 minutes, by which time level 4 (3.1 hr average residence) has been drying at a progressively higher rate for over an hour and is ready to go at approx. 185° F. The same principle applies to any required drying time. An air flow of 60 cfm (1:1) heats faster and will reduce heat-up time of level 0 by about 40%, but it will reduce start-up time by only 6-8 min. And if the hopper design does not efficiently heat material in the cone as the present engineered hopper does, additional time and effort are required to drain the un-dried material before starting.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A dryer for material, comprising:

a hopper having an interior formed by a wall section, a first end section and a second end section, the wall section enclosing the side or sides of the hopper, the wall section including an inner wall forming an outer periphery for the interior of the hopper, the first end section enclosing the hopper at one end of the wall section, and the second end section enclosing the hopper at an opposite end of the hopper;

the hopper further having an air inlet at or near the second end section and an air outlet at or near the first end section, an inlet at or near the first end section for introducing material to be dried into the interior of the hopper, and an outlet at or near the second end section for discharging material to be dried out of the hopper;

the interior of the hopper having a hollow first portion providing an unobstructed passageway for material introduced into the interior of the hopper from the material inlet; and the interior of the hopper having a second portion in communication with the hollow first portion, the second portion including a first perforated section located about a central axis of the hopper, the first perforated section having an outer peripheral edge spaced inwardly apart from the interior wall of the wall section, the second portion further including a second perforated section, a first portion of the second perforated section being adjacent to the inner wall of the wall section and a second portion of the second perforated section providing an opening in communication with the material outlet through which material may pass, the second perforated section having an interior wall having perforations there through, the perforations being in communication with the air inlet providing a passageway for air introduced into the interior of the hopper to flow through the air inlet and through the perforations in the interior wall of the second perforated section and directing air into the interior of the hopper, the first perforated section having an open area and the second perforated section having an open area, the open area of the first perforated section being greater than the open area of the second perforated section;

the outer peripheral edge of the first perforated section spaced apart from the inner wall of the second perforated section providing a passageway in between the interior wall of the second perforated section and the outer peripheral edge of the first perforated section, the passageway being in communication with the material outlet allowing material introduced into the interior of the hopper to pass between the interior wall of the second perforated section the and the outer peripheral edge of the first perforated section and out of the hopper through the material outlet.

2. The dryer of claim 1, wherein the open area of the interior wall of the conical section is about 2.5% or less of the total interior surface of the interior wall, and the open area of the perforated surface of the inverted cone is about 33% or higher.

3. The dryer of claim 1, wherein the open area of the interior wall of the conical section provides a back pressure of about 1 psi or less in air passing through the conical section.

4. The dryer of claim 1, wherein the second perforated section includes a conical section, the conical section including an upper portion positioned adjacent to the inner wall of the wall section and including a lower portion truncated to provide an opening in communication with the material outlet through which material may pass, the conical section having an interior wall having perforations there through, the perforations being in communication with the air inlet providing a passageway for air introduced into the interior of the hopper to flow through the air inlet and through the perforations in the interior wall of the conical section and directing air into the interior of the hopper and to flow along the interior wall of the wall section towards the hollow first portion of the hopper, the lower portion further including an inverted cone section positioned inside of the conical section and above the opening in the conical section, the inverted cone section having an outer lower peripheral edge spaced apart from the interior wall of the conical section, the spacing providing a passageway in between the interior wall of the conical section and the outer peripheral edge of the inverted cone section, the passageway being in communication with the material outlet allowing material introduced into the interior of the hopper to pass between the interior wall of the conical section the and the outer peripheral edge of the inverted cone section and out of the hopper through the material outlet.

5. The dryer of claim 1, wherein the conical section further includes an outer wall spaced apart from the inner wall of the conical section, the spacing between the inner and outer walls of the conical section forming a passageway that is in communication with the air inlet.

6. The dryer of claim 5, further including a conduit in communication with the air inlet, and the passageway formed between the inner and outer walls of the conical section.

7. The dryer of claim 1, wherein the inner wall of the conical section is positioned at an angle with respect to the inner wall of the wall section of the hopper in the range of about 55° to about 65°.

8. The dryer of claim 1, further including a blower and a conduit in communication with the blower and the air inlet for delivering air for drying material introduced into the hopper, a measurement device to measure the flow of air delivered through the conduit by the blower, and a controller in communication with the measurement device for receiving air flow measurements from the measurement device and controlling the blower based on the air flow measurements.

9. The dryer of claim 8, wherein air delivered into the interior of the hopper is delivered counter current to a flow of material through the hopper.

10. The dryer of claim 9, wherein the controller is configured to control the blower to deliver about 0.6 cfm of air per pound of material into the hopper.

11. The dryer of claim 8, wherein the controller is configured to control the blower to deliver between about 0.5 cfm to about 0.7 cfm of air per pound of material into the hopper.

12. A method of drying material, comprising the steps of:

providing a hopper having an interior formed by a wall section, a first end section and a second end section, the wall section enclosing the side or sides of the hopper, the wall section including an inner wall forming an outer periphery for the interior of the hopper, the first end section enclosing the hopper at one end of the wall section, and the second end section enclosing the hopper at an opposite end of the hopper, the hopper further having an air inlet at or near the second end section and an air outlet at or near the first end section, an inlet at or near the first end section for introducing material into the interior of the hopper, and an outlet at or near the second end section for discharging material out of the hopper, the interior of the hopper having a hollow first portion providing an unobstructed passageway for material introduced into the interior of the hopper from the material inlet; and a second portion in communication with the first portion, configuring the second portion to include a first perforated section located about a central axis of the hopper and having an outer periphery spaced inwardly apart from the inner wall of the wall section and a second perforated section located between the outer periphery of the first perforated section and the inner wall of the wall section, the first perforated section having an open area and the second perforated section having an open area, the open area of the first perforated section being greater than the open area of the second perforated section;

introducing material into the interior of the hopper through the material inlet and passing the material through the hollow upper portion of the interior of the hopper in plug flow; and delivering air into the interior of the hopper through the air inlet and passing the air through the interior of the hopper counter-current to the flow of material through the interior of the hopper.

13. The method of claim 12, wherein the open area of the interior wall of the conical section is about 2.5% or less of the total interior surface of the interior wall, and the open area of the perforated surface of the inverted cone is about 33% or higher.

14. The method of claim 13, wherein the second perforated section includes a conical section, the conical section including an upper portion positioned adjacent to the inner wall of the wall section and including a lower portion truncated to provide an opening in communication with the material outlet through which material may pass, the conical section having an interior wall having perforations there through, the perforations being in communication with the air inlet providing a passageway for air introduced into the interior of the hopper to flow through the air inlet and through the perforations in the interior wall of the conical section and directing air into the interior of the hopper and to flow along the interior wall of the wall section towards the hollow first portion of the hopper, the lower portion further configured to include an inverted cone section positioned inside of the conical section and above the opening in the conical section, the inverted cone section having an outer lower peripheral edge spaced apart from the interior wall of the conical section, the spacing providing a passageway in between the interior wall of the conical section and the outer peripheral edge of the inverted cone section, the passageway being in communication with the material outlet allowing material introduced into the interior of the hopper to pass between the interior wall of the conical section the and the outer peripheral edge of the inverted cone section and out of the hopper through the material outlet.

15. The method of claim 12, wherein the open area of the interior wall of the conical section provides a back pressure of about 1 psi or less in air passing through the conical section.

16. The method of claim 12, wherein the air delivered into the interior of the hopper is heated air and includes heated air directed to flow along the interior wall of the wall section towards the first end section of the hopper.

17. The method of claim 12, wherein the material introduced into the interior of the hopper is passed through the hollow first portion of the hopper in plug flow.

18. The method of claim 12, further including a blower for delivering the air for drying material into the interior of the hopper.

19. The method of claim 18, further including the step of controlling the blower to deliver between about 0.5 cfm and about 0.7 cfm of air per pound of material.

20. The method of claim 18, further including the step of controlling the blower to deliver about 0.6 cfm of air per pound of material.

* * * * *